US011613868B2

(12) United States Patent
Bergeron

(10) Patent No.: US 11,613,868 B2
(45) Date of Patent: Mar. 28, 2023

(54) EXCAVATOR MOUNTED HEAD AND ASSEMBLY FOR SUPPORTING AND ANGULARLY ADJUSTING A CLAMSHELL STYLE BUCKET ASSEMBLY DURING SUCH AS A DREDGING OPERATION

(71) Applicant: Raymond E. Bergeron, Trenton, MI (US)

(72) Inventor: Raymond E. Bergeron, Trenton, MI (US)

( * ) Notice: Subject to any disclaimer, the term of this patent is extended or adjusted under 35 U.S.C. 154(b) by 294 days.

(21) Appl. No.: 17/003,403

(22) Filed: Aug. 26, 2020

(65) Prior Publication Data

US 2021/0062454 A1 Mar. 4, 2021

Related U.S. Application Data

(60) Provisional application No. 62/892,687, filed on Aug. 28, 2019.

(51) Int. Cl.

| | |
|---|---|
| ***E02F 3/47*** | (2006.01) |
| ***E02F 3/60*** | (2006.01) |
| ***E02F 3/36*** | (2006.01) |
| ***E02F 3/40*** | (2006.01) |
| ***E02F 5/28*** | (2006.01) |
| ***E02F 9/22*** | (2006.01) |

(Continued)

(52) U.S. Cl.

CPC ..... *E02F 3/3677* (2013.01); *E02F 3/40* (2013.01); *E02F 5/28* (2013.01); *E02F 9/22* (2013.01); *B66C 3/005* (2013.01); *B66C 3/02* (2013.01)

(58) Field of Classification Search

CPC ..... E02F 3/4135; E02F 3/3677; E02F 3/342; E02F 3/404; E02F 3/413; E02F 3/47; E02F 3/60; B66C 3/02; B66C 3/16; B66C 3/12; B66C 3/125

See application file for complete search history.

(56) References Cited

U.S. PATENT DOCUMENTS 512,825 A * 1/1894 Hunt ..... B66C 3/12 37/186
531,486 A * 12/1894 Upton ..... B66C 13/08 414/625

(Continued)

*Primary Examiner* — Edwin J Toledo-Duran
(74) *Attorney, Agent, or Firm* — Dinsmore & Shohl LLP

(57) ABSTRACT

A tilt adjustable head attachment assembly for a clamshell style bucket for orienting first and second bucket halves at an angle relative to a length axis extending through an elongated and rigid attachment associated with a piece of power equipment, for supporting and manipulating the bucket. A frame has a three dimensional body, upwardly extending pillar mounts located at upper ends of the body and incorporating support shafts for receiving overlapping hinged locations associated with support arms for each of the first and second clamshell bucket halves. A platen is positioned pivotally arranged between the pillar mounts and includes an upper location engaged by an end projection of the elongated attachment. A cylinder is connected to a fixed underside location of the frame at a first end and to the platen at a second end and, upon being actuated, pivotally displacing the platen to in turn angle the frame and supported clamshell bucket halves relative to the excavator attachment according to a desired orientation.

7 Claims, 11 Drawing Sheets

(51) Int. Cl.
*B66C 3/00* (2006.01)
*B66C 3/02* (2006.01)

(56) References Cited

U.S. PATENT DOCUMENTS 536,756 A * 4/1895 Meier ..... B66C 13/08 212/292
644,457 A * 2/1900 Pless ..... E02F 3/4131 37/340
652,738 A * 7/1900 Arnold ..... E02F 3/4131 37/340
925,018 A * 6/1909 Ouchterlony ..... B66C 3/12 37/188
1,096,214 A * 5/1914 Andersen ..... B66C 3/12 37/184
2,196,649 A * 4/1940 Waite ..... E02F 3/4135 212/299
2,217,629 A * 10/1940 Williams ..... E02F 3/4131 37/187
2,382,955 A * 8/1945 Billings ..... B66C 3/16 414/625
2,499,433 A * 3/1950 Waite ..... E02F 3/47 73/864.42
2,501,594 A * 3/1950 Billings ..... B66C 3/16 37/187
2,605,563 A * 8/1952 Browning ..... B66C 3/16 212/251
2,691,963 A * 10/1954 Seng ..... F15B 15/24 92/51
2,731,163 A * 1/1956 Wills ..... B66C 3/20 414/732
2,828,038 A * 3/1958 Dorkins ..... E02F 3/306 414/733
2,837,846 A * 6/1958 Long ..... B66C 3/16 37/186
3,061,957 A * 11/1962 Fehlmann ..... E02F 3/47 37/195
3,116,845 A * 1/1964 Holopainen ..... B66C 3/16 414/726
3,143,229 A * 8/1964 Billings ..... E02F 3/4136 414/734
3,462,029 A * 8/1969 Mork ..... E02F 3/4135 37/461
3,517,960 A * 6/1970 Mork ..... E02F 3/413 37/461
3,574,387 A * 4/1971 Hahn ..... B66C 3/16 294/198
3,586,362 A * 6/1971 Kramer ..... B66C 3/16 294/68.23
3,722,448 A * 3/1973 Leonardi ..... B63C 7/24 37/340
3,737,059 A * 6/1973 Peterson ..... E02F 3/404 414/726
3,877,743 A * 4/1975 Johnson ..... B66C 3/16 414/735
3,896,950 A * 7/1975 McCain ..... E02F 3/4135 37/461
3,914,886 A * 10/1975 Berg ..... E02F 9/123 294/86.41
3,917,322 A * 11/1975 Berg ..... F16L 39/04 285/190
3,920,137 A * 11/1975 McCain ..... E02F 3/4135 294/68.23
3,985,384 A * 10/1976 Hahn ..... B66C 3/16 294/68.23
4,239,273 A * 12/1980 Dodemont ..... B66C 3/16 37/186
4,327,943 A * 5/1982 Longo ..... B66C 3/16 294/68.23
5,193,873 A * 3/1993 Juliusz ..... B66C 3/16 294/68.23
5,330,242 A * 7/1994 Lucky, Sr. ..... B66C 3/04 D15/28
5,398,430 A * 3/1995 Scott ..... E02F 3/967 37/189
5,443,294 A * 8/1995 Prinz ..... B66C 3/16 294/68.23
5,473,828 A * 12/1995 Kishi ..... E02F 9/2203 294/68.23
5,638,616 A * 6/1997 Kishi ..... E02F 9/2275 414/718
5,653,489 A * 8/1997 Fandrich ..... B66C 1/585 294/110.1
5,836,089 A * 11/1998 Lipsker ..... E02F 9/2275 299/11
6,347,464 B1 * 2/2002 Klager ..... E02F 3/4135 294/68.23
9,452,912 B1 * 9/2016 Bergeron ..... E02F 3/4135
10,308,484 B2 * 6/2019 Bergeron ..... E02F 3/413
2019/0062126 A1 * 2/2019 Scotto ..... B66C 3/02

* cited by examiner

EXCAVATOR MOUNTED HEAD AND ASSEMBLY FOR SUPPORTING AND ANGULARLY ADJUSTING A CLAMSHELL STYLE BUCKET ASSEMBLY DURING SUCH AS A DREDGING OPERATION

CROSS REFERENCE TO RELATED APPLICATIONS

The present application claims the priority of U.S. Ser. No. 62/892,687 filed Aug. 28, 2019.

FIELD OF THE INVENTION

The present invention relates to clamshell style buckets utilized in dredging operations. More specifically, the present invention discloses a clamshell style bucket with a tilt-able head assembly, such as attached to a rigid excavator arm, to permit angularly adjusting the bucket during such as a channel dredging operation.

BACKGROUND OF THE INVENTION

The prior art is documented with examples of clamshell style dredging buckets. Non-limiting examples of these are shown in U.S. Pat. Nos. 10,308,484 and 9,452,912, both to Bergeron, and which teach first and second pivotally interconnected bucket halves and which are capable of being suspended from a crane cable or, in instances, from a first end of an articulating arm such as associated with an excavator.

Variants of the bucket designs can further include mechanical opening and closing of the clamshell halves about a common pivot point and through any arrangement of cables or chains connected directly to the bucket halves or to associated swing arms or brackets. The bucket halves can also be moved between the open and closed positions via the provision of hydraulic cylinders incorporated into the assembly, such as in cooperation with the support mounted brackets and/or swing arms. Alternatively, the individual cylinders can be substituted by a hydraulic pressure source which can be integrated into the crane or excavator, to which the bucket assembly is attached or suspended.

Another more recent design of note is the clamshell bucket with aux-bail carriage assembly disclosed in US 2019/0062126 to Scotto et al. The aux-bail release mechanism operates such that movement of the chains is restrained, resulting in an auxiliary hook actuating the release mechanism in a smooth and controlled manner from a variety of angles and positions, while reducing or eliminating bucket roll from offset pulling. The release mechanism can include a carriage configured to translate along at least a portion of a mast and operatively connected to first and second clamshell portions such that movement of the carriage away results in rotation of the clamshell portions toward the open position.

SUMMARY OF THE PRESENT INVENTION

The present invention discloses a tilt adjustable head attachment assembly for a clamshell style bucket for orienting first and second bucket halves at an angle relative to a length axis extending through an elongated attachment associated with a piece of power equipment, and for supporting and manipulating the bucket. The attachment assembly includes a frame having a three dimensional body. A pair of upwardly extending pillar mounts are located at upper ends of the body and incorporate support shafts for receiving overlapping hinged locations associated with support arms for each of the first and second clamshell bucket halves.

A platen is positioned in a pivotally arranged fashion between the pillar mounts and includes an upper location adapted to be engaged by an end projection of the elongated attachment. A cylinder is connected to a fixed underside location of the frame at a first end and to the platen at a second end and, upon being actuated, pivotally displaces the platen to in turn angle the frame and supported clamshell bucket halves relative to the excavator attachment at a dedicated angular orientation.

Other features include the cylinder being supported between spaced apart and opposing pairs of cylinder mount brackets extending the frame and an underside of the pivotally supported platen. A plurality of angular position adjustment slots are formed in the frame in additional to selectively aligning slots formed in support arms associated with the pivotal platen, a hold bar inserting through the aligning slots in order to secure the platen in an adjusted tilt position relative to the frame and bucket halves.

A mounting shaft extends through aligning apertures defined in first and second platen support arms and the frame in order to pivotally support the platen. The platen further includes an annular shaped lower platen member and a rotatably supported upper annular shaped platen member which define a bearing supported carriage for rotating the frame and hingedly connected buckets about the length axis extending through the elongated attachment. Yet additional features include a head attachment secured atop the platen and including a base plate with upwardly extending side plates, an end of the extending member adapted to seats against the base plate and receiving a widthwise extending engagement pin supported by the upper extending plates in order to affix the frame of the tilt assembly to the elongated attachment of the power equipment.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference now to the attached drawings, the present invention discloses a clamshell style bucket with a tilt-able head assembly, see as generally shown at 10, such as attached to a rigid arm 4 of an associated excavator 2 of like piece of power equipment, such as a dredger, and to permit angularly adjusting the bucket during such as a channel dredging operation. As will be further described, the ability to tilt the bucket at varying angles relative to the excavator arm 4 is particularly useful in dredging applications such as associated with clearing or deepening irregular bottom surfaces, and further not limited to expanding underwater channels or other non-horizontal underwater topographical profiles.

Figure 1:
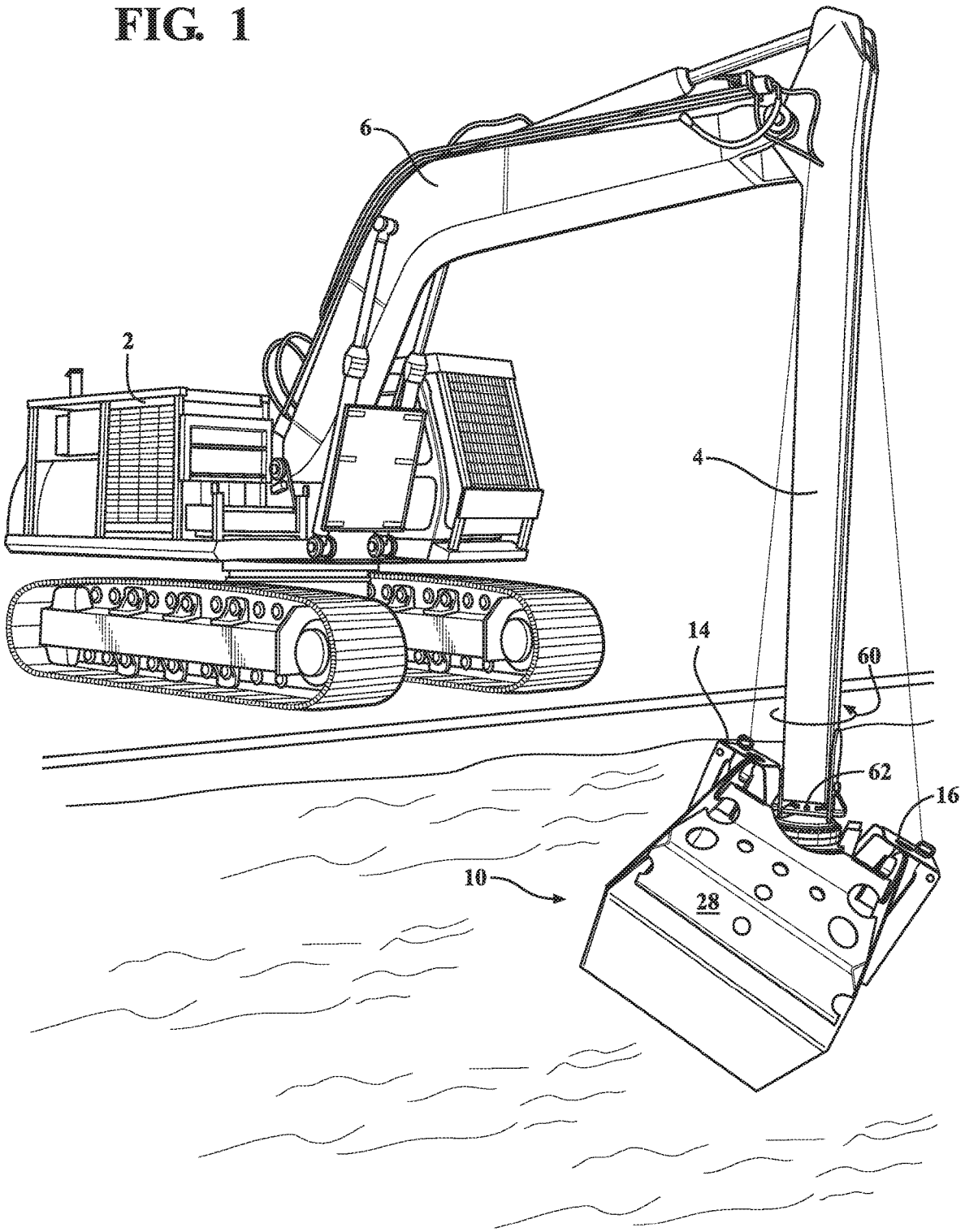
FIG. 1 is an environmental view of the bucket assembly according to the present invention in which the tilt subassembly incorporated into the head attachment orients the bucket halves to an angle relative to the elongated attachment (and such as relative to a horizontal surface in the instance of the attachment extending in a vertical downward direction)

As further shown, the operating machinery depicted at 2 is not understood to not be limited to an excavator/dredger, and can include other suitably constructed power equipment which includes an extending main boom or other elongated support (see as depicted at 6 in FIG. 1), and from which the end extending elongated support member 4 is pivotally connected in the manner shown in FIG. 1 in order to facilitate the attached bucket to be repetitively displaced (such as including but not limited to successive up/down directions and/or a desired vertical distance) in order to accomplish effective dredging or excavation recessed areas.

Figure 2:
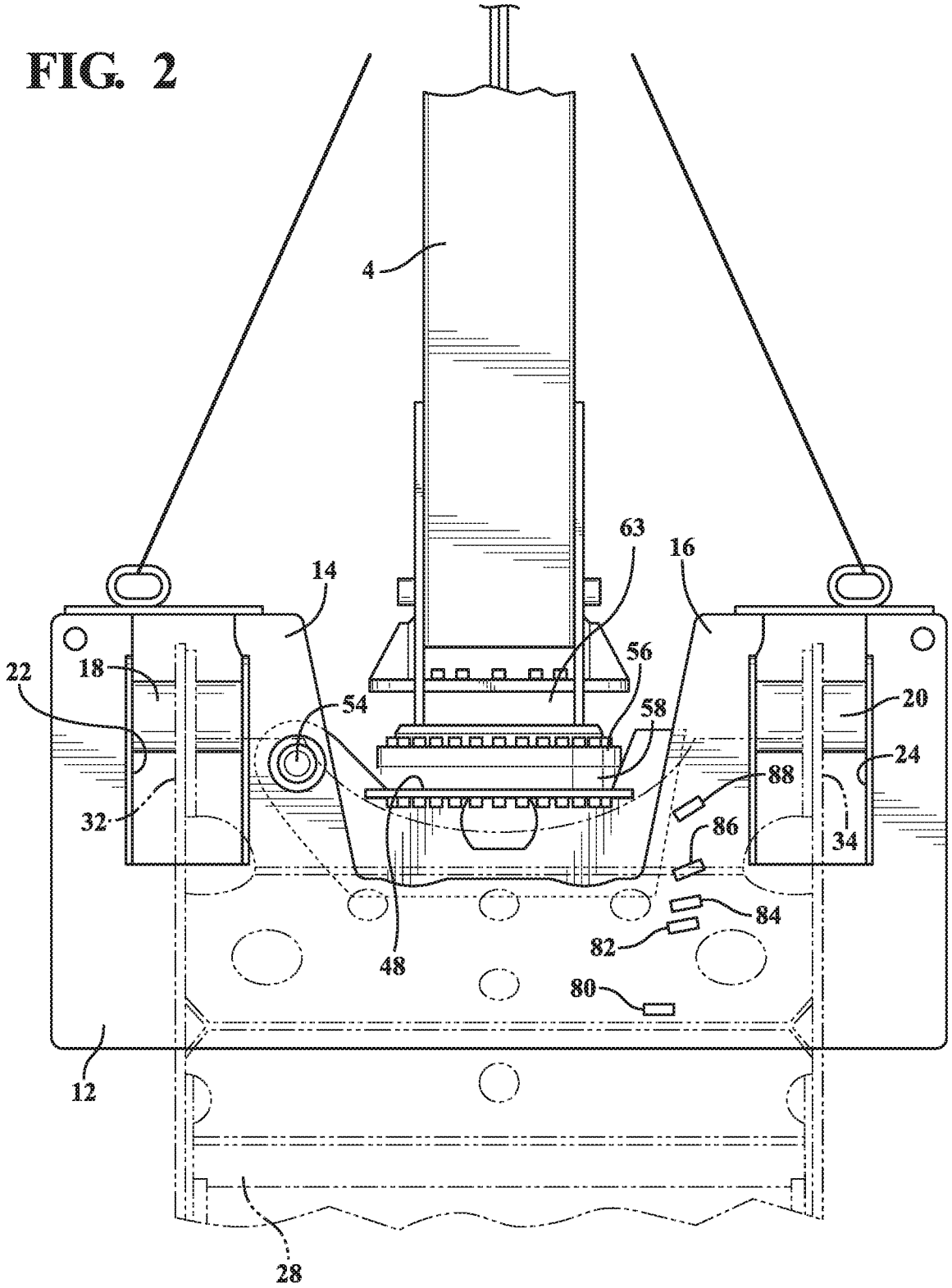
FIG. 2 is a plan view illustration of the bucket assembly of FIG. 1 with the head subassembly in a horizontal adjusted position and further showing the plurality of angular adjustment positions such for receiving a retainer bar in order to lock in place a desired angular position of the tilt head subassembly relative to the pivotally supported buck halves.
Figure 3:
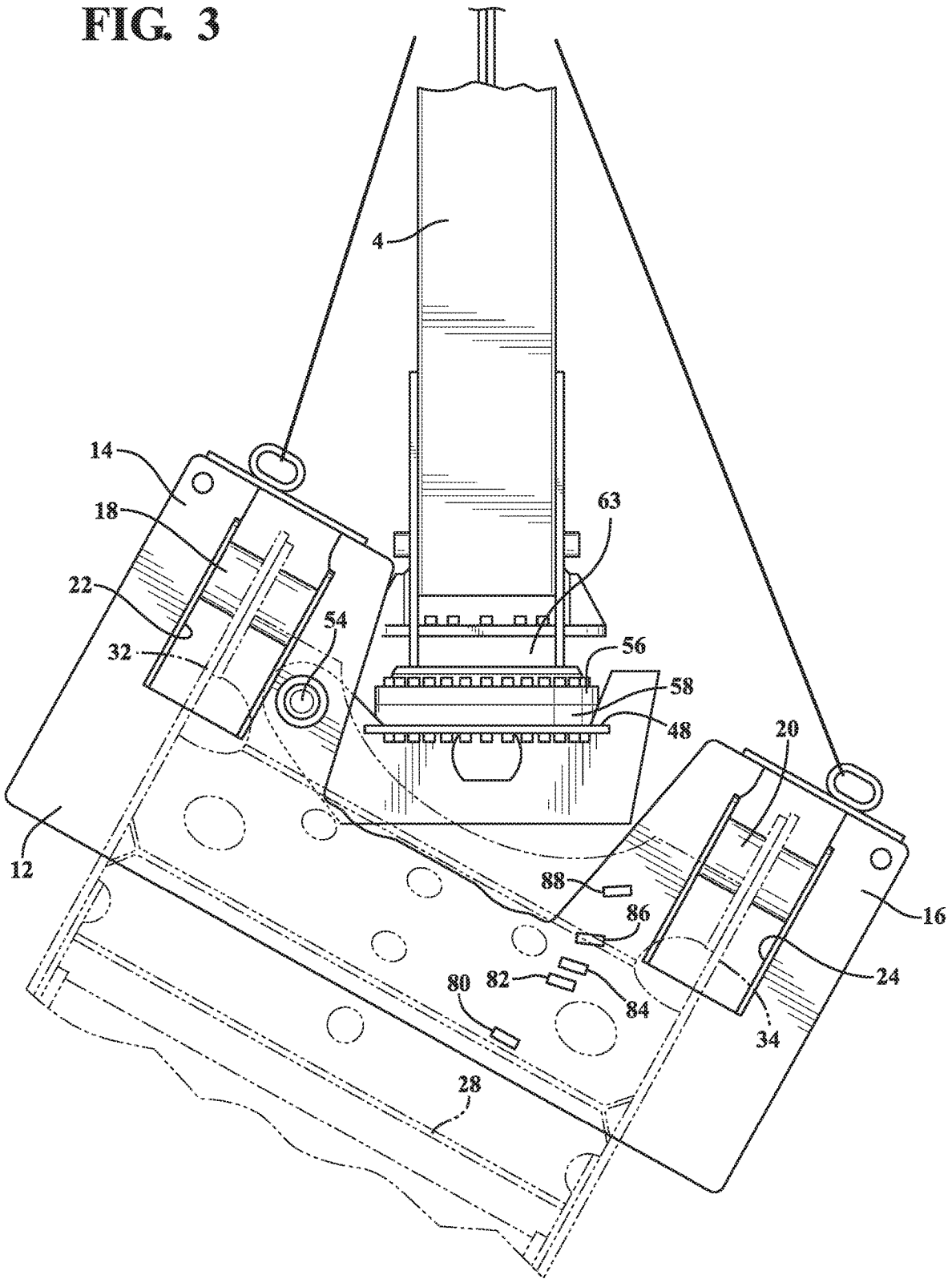
FIG. 3 is a succeeding illustration to FIG. 2 in a desired angular offset orientation similar to that depicted in FIG. 1.
Figure 4:
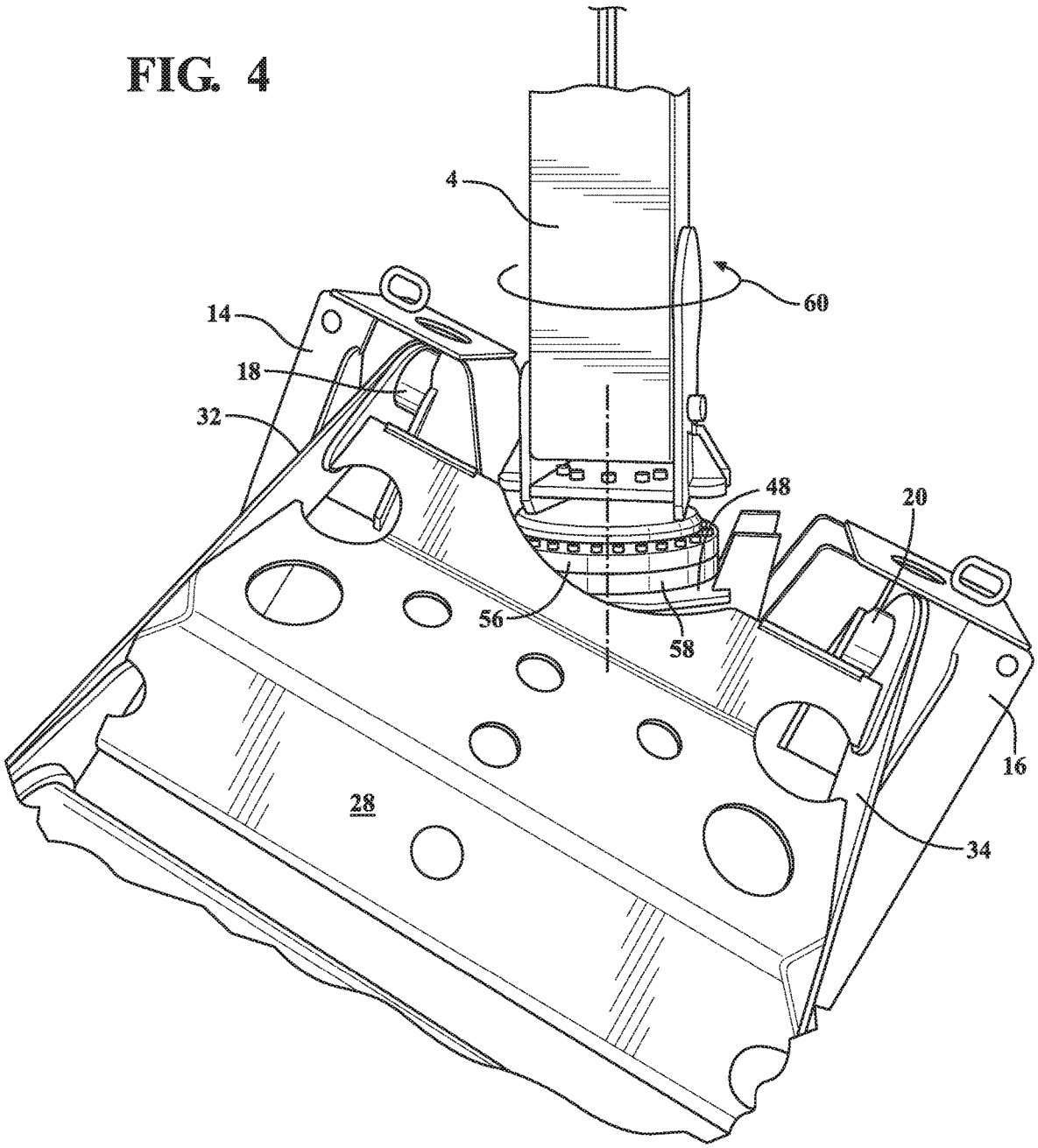
FIG. 4 is a similar view to FIG. 3 with the bucket halves depicted in solid.
Figure 5:
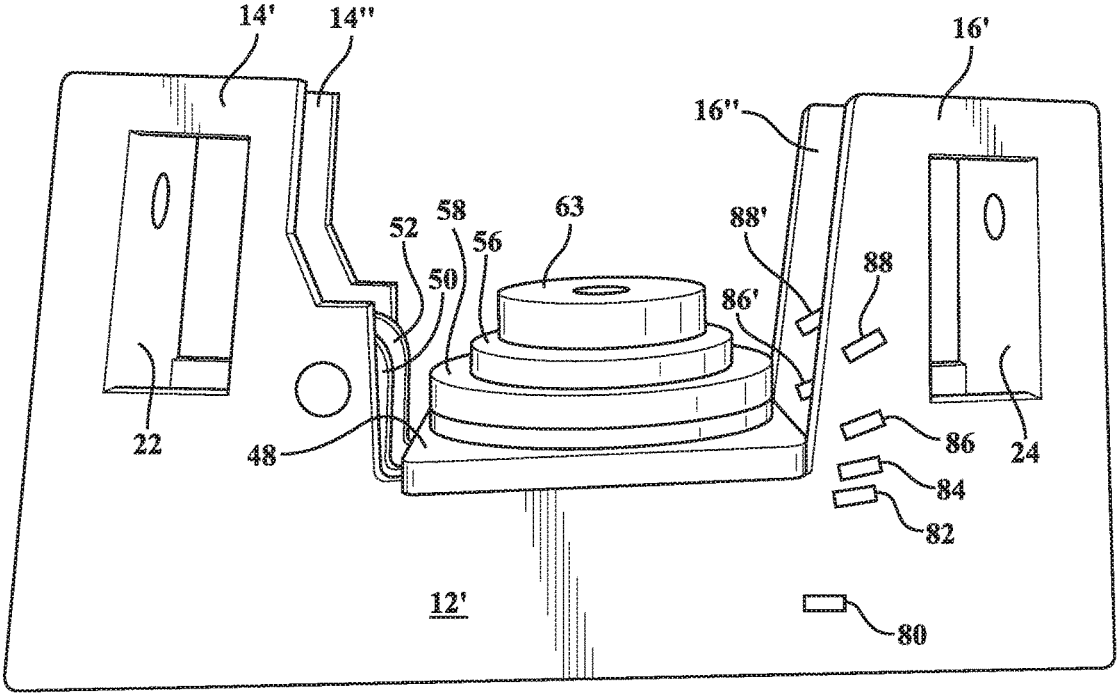
FIG. 5 is an illustration of a head attachment tilt subassembly according to a further embodiment and corresponding to the plan view illustration of FIG. 2.
Figure 6:
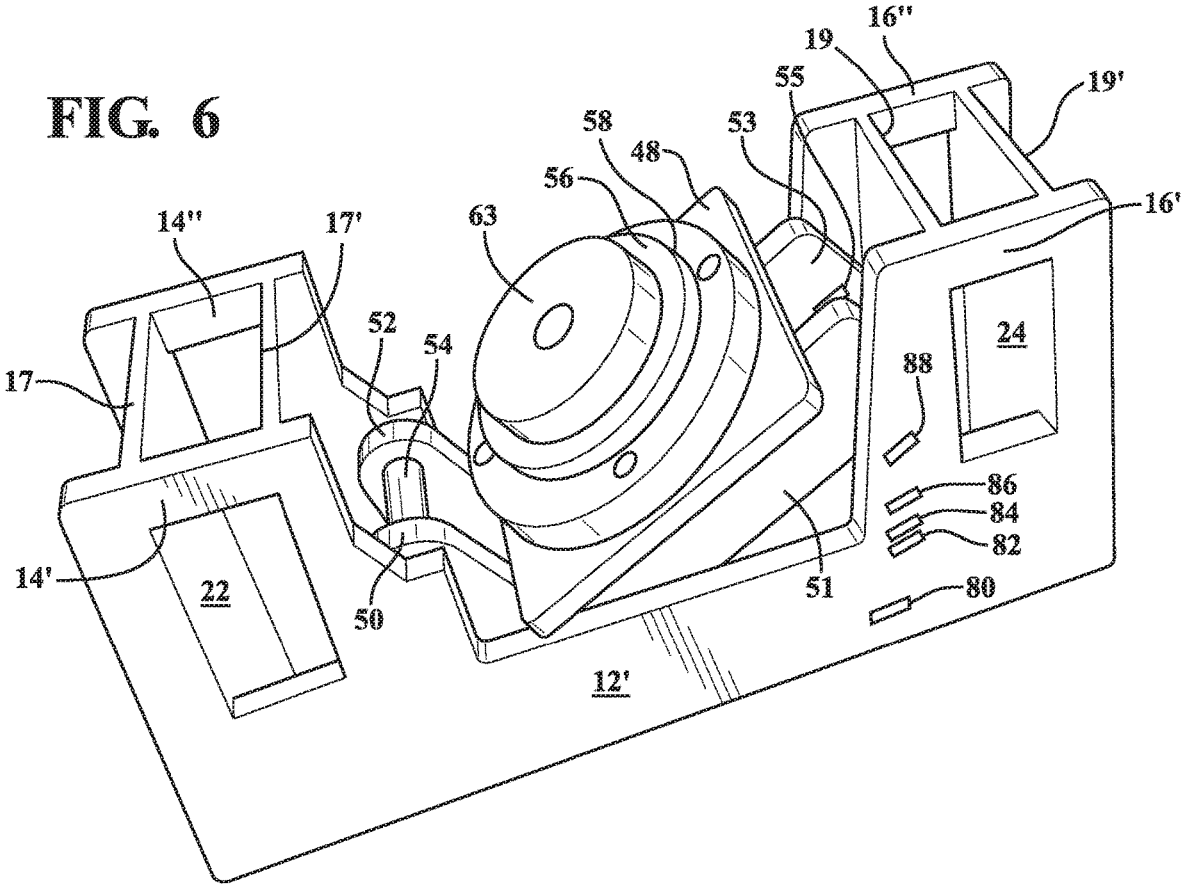
FIG. 6 is a succeeding view to FIG. 5 and depicting the tilt head subassembly in an pivoted position consistent with that shown in prior FIGS. 1, 3 and 4.

With additional reference to FIGS. 2-7 in succession, a head attachment assembly includes a three dimensional main frame or body, best referenced at 12 in FIGS. 2-3 as well as at 12' in the alternate views of FIGS. 5-6. The frame includes a pair upwardly extending pillar mounts 14 and 16 for pivotally supporting the bucket. As will be further described in reference to the alternate variant of FIGS. 5-6.

The pillars in the alternate variant of FIGS. 5-6 are further depicted by a forward plate or wall with forward pillar locations 14'/16' and a rearward spaced plate or wall with rearward spaced pillar locations 14" and 16". As best shown in FIG. 6, the forward and rearward spaced pillar defining plates 14'/14" and 16'/16" are reinforced, respectively, by crosswise members 17/17' and 19/19"

Figure 9:
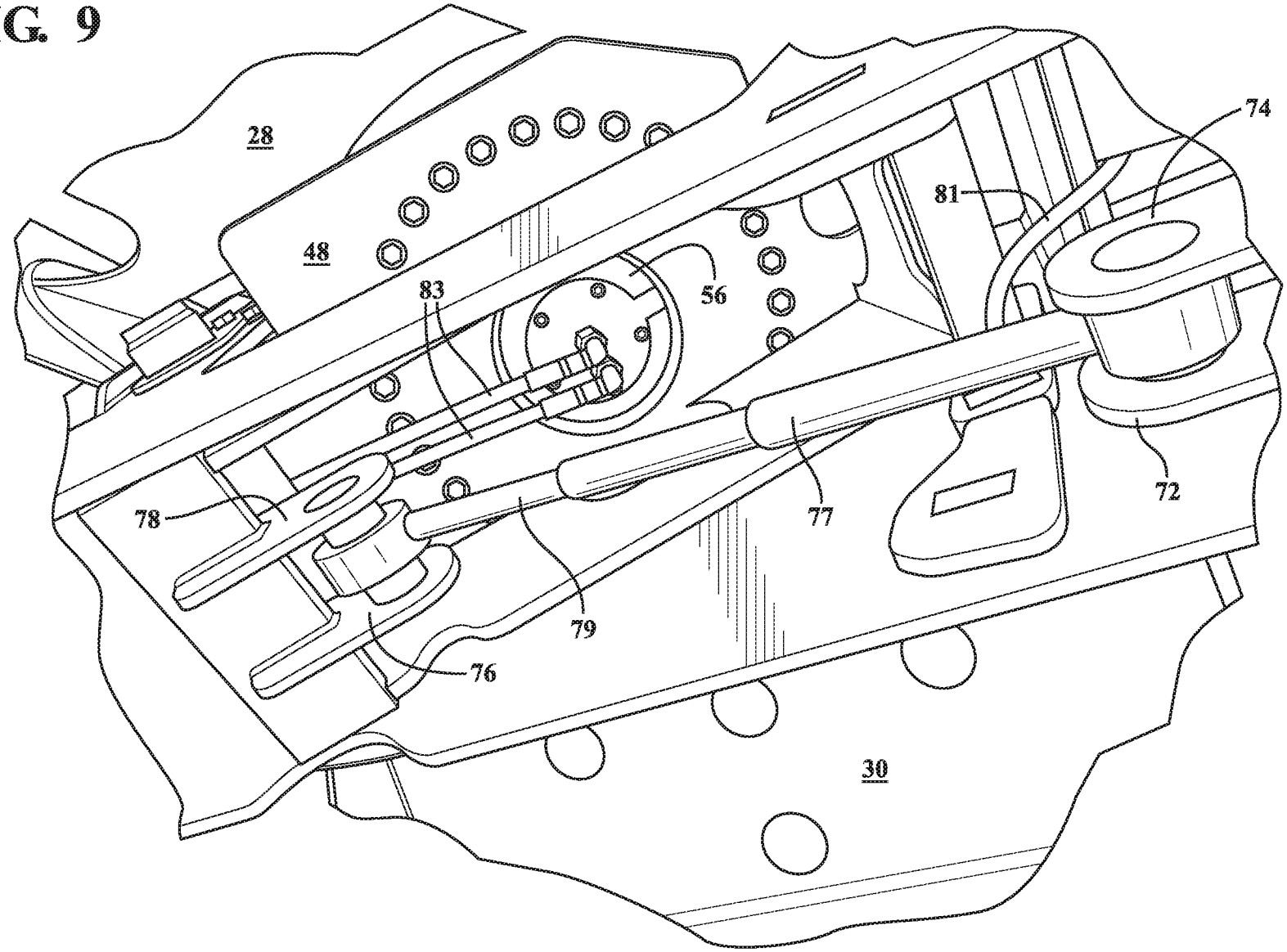

A pair of support shafts 18 and 20 (see as best shown in FIGS. 2-4) are located in horizontal extending fashion within each of the pillar mounts 14/16 and are visible through open sided rectangular profiles (see at 22 and 24) defined in overlapping opposing sides of the pillar mounts 14/16 (as well as the spaced apart pillar plates 14'/14" and 16'/16" in FIGS. 5-6), this in order receive overlapping hinged end locations of first 28 and second 30 bucket clamshell halves (see also FIG. 9).

As best shown in FIGS. 2-4 and 7, and with reference to the illustrated bucket half 28, flattened arms 32 and 34 extend from upper ends of the bucket half 28 through the open window profiles 22/24 of the head subassembly pillar mounts 14/16. The bucket end supporting arms 32/34 are configured at end locations (such as to include circular apertures) for mounting (such as by welding) to each of the bucket halves (again as best shown at 28) to each of the cylindrical support shafts 18/20. Although not clearly shown, the second bucket half 30 includes a similar arrangement of flattened mounting arms (see further at 32' in FIGS. 12 and 34' in FIG. 13) which mount through an opposite rear side of the window profiles and so that the bucket halves 28 and 30 are hingedly supported by the frame 12 between pivotally opened and closed positions.

Pivoting of the bucket halves 28/30 occurs between opened and closed positions as defined by inner sealing lip edges, these not shown however which can include rubberized or other deformable membranes formed along opposing inner sealing edge of the bucket halves. The membranes can each be configured in an arcuate or looped shape with a hollow interior for causing pinching or deformation during closing the of bucket halves to prevent spillage of aggregate captured between the bucket halves.

Figure 12:
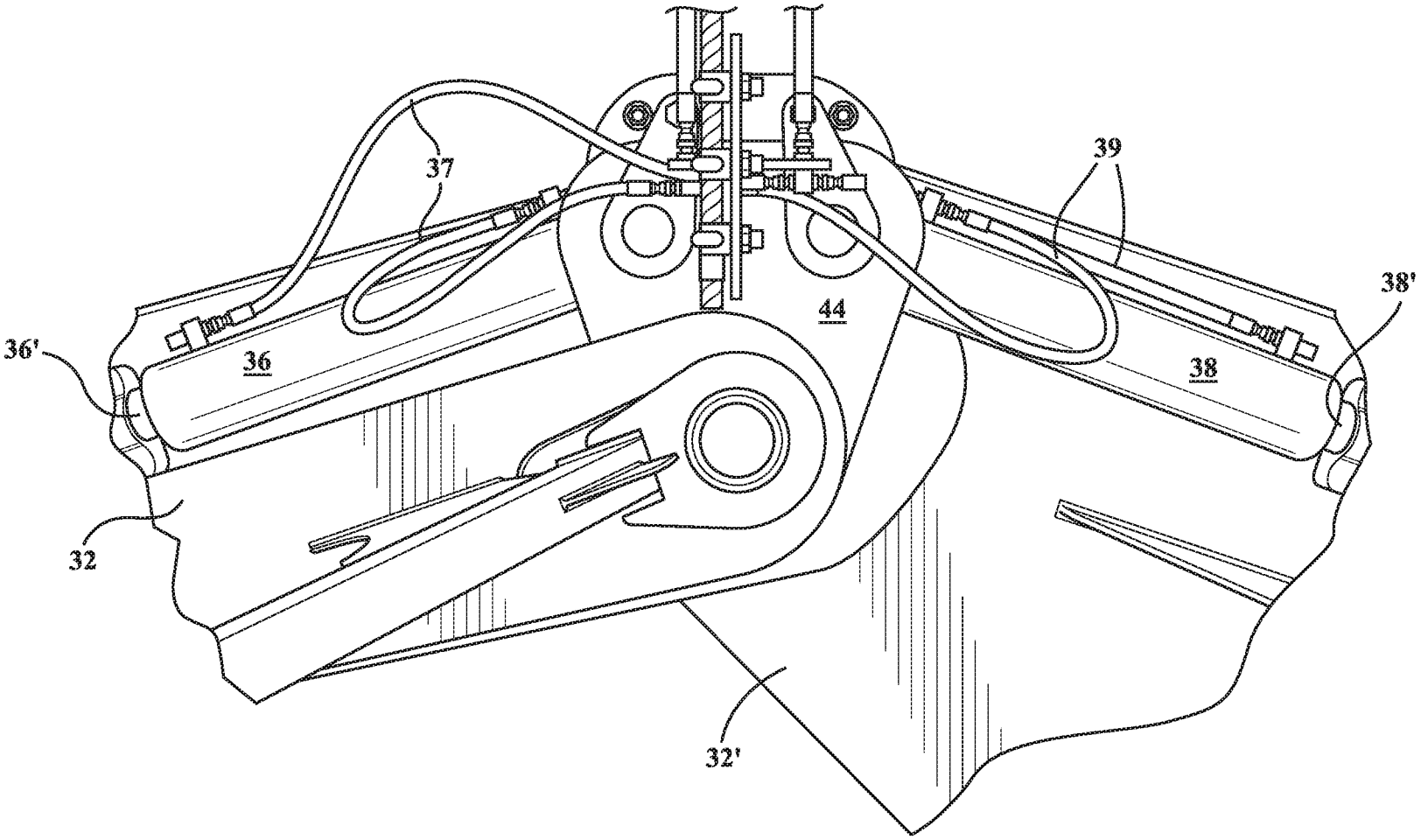
FIG. 12 depict a pair of plan and rotated perspective view of an articulating connection established between the bucket halves.
Figure 13:
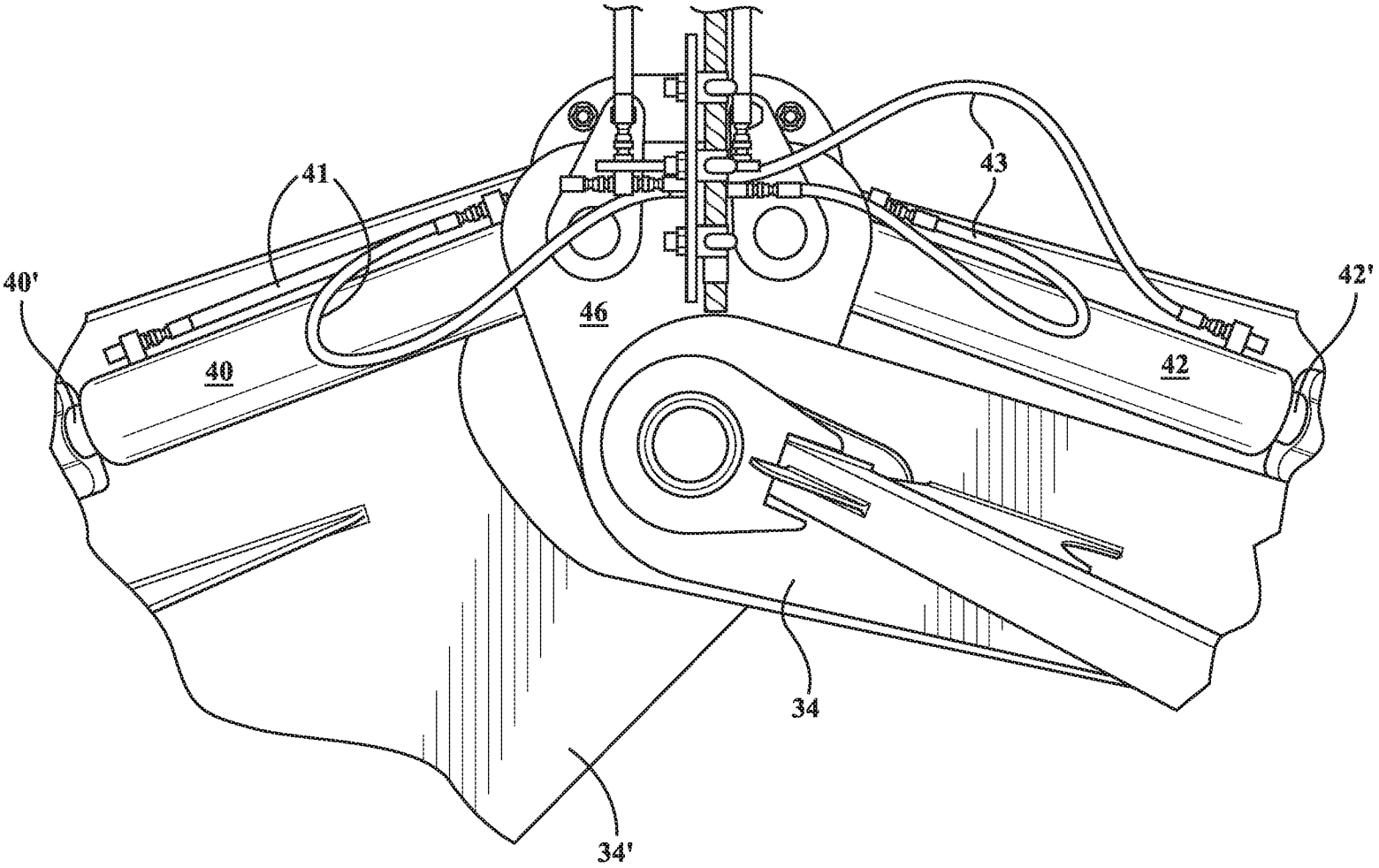
FIG. 13 is a view similar to FIG. 12 of an opposite side of the bucket halves and depicting an aligning pivotal connection along with the provision of hydraulic drive cylinders and hookups.

Additional features further include the provision of hydraulic cylinders (or other suitable fluid actuators), these best shown in each of FIGS. 12 and 13 at 36/38 and 40/42, and which are supplied by fluid conduits (see individual pairs at 37, 39, 41 and 43 respectively for each cylinder 36, 38, 40 and 42) for opening and closing the bucket halves. Inner hingedly supported ends of the cylinders are mounted to fixed support locations (see at 44 in FIG. 12 and further at 46 in FIG. 13) positioned at opposite side locations of the head attachment frame 12 and offset from the support shafts 18/20, with opposite outer ends of an inner telescoping member for each cylinder further mounting to a further side wall of an associated bucket halve 28/30 for maximizing the pivoting forces exerted upon the bucket halves 28/30. With reference to FIGS. 12-13, cylinders 36/38 each include inner telescoping members 36'/38', with cylinders 40/42 each further including inner telescoping members 40'/42' secured at projecting ends to locations of the bucket halves 28/30 for effectuating pivotal opening and closing.

As further shown in FIGS. 12-13, the pairs of (typically hydraulic) fluid lines 37, 39, 41 and 43, along with associated hookups (such as which can be provided from the excavator 2) can extend to each of the cylinders 36/38 and 40/42 and are alternatively energized/vented through the application of pressurized fluid for actuating the respective inner telescoping members and, by extension, the clamshell bucket halves 28/30 between the open and closed positions.

A head attachment tilt subassembly depicts a pivotally adjustable platen 48 positioned approximate a central recessed or interior separation location of the three dimensional frame (again at 12 in FIG. 1 and at 12' in FIG. 5), and so that the platen 48 is positioned centrally and between the bucket halve pillar mounts. As further best shown in the tilt position of FIG. 6, a pair of arms 51/53 are welded to an underside surface of the platen 48 (shown depicted in upwardly extending direction) and are in turn arranged in contact against inside edges of the front and back walls of the tilt assembly frame.

A mounting shaft 54 extends through aligning apertures defined in upper end hinged portions, at 50/52 of the platen arms 51/53. The arms 51/53 can be integrated as elongate and platen underside extending members and, as shown in FIG. 5, can further including alignment slots defined at ends thereof (one of which is visible at 55 for arm member 53 in FIG. 6). As will be further described in reference to FIGS. 8-11 the alignment slots in the arms 51/53 align with pairs of slots in the outer frame members 14/16 for securing a selected tilt position of the platen 48 relative to the attachment frame 12.

Figure 7:
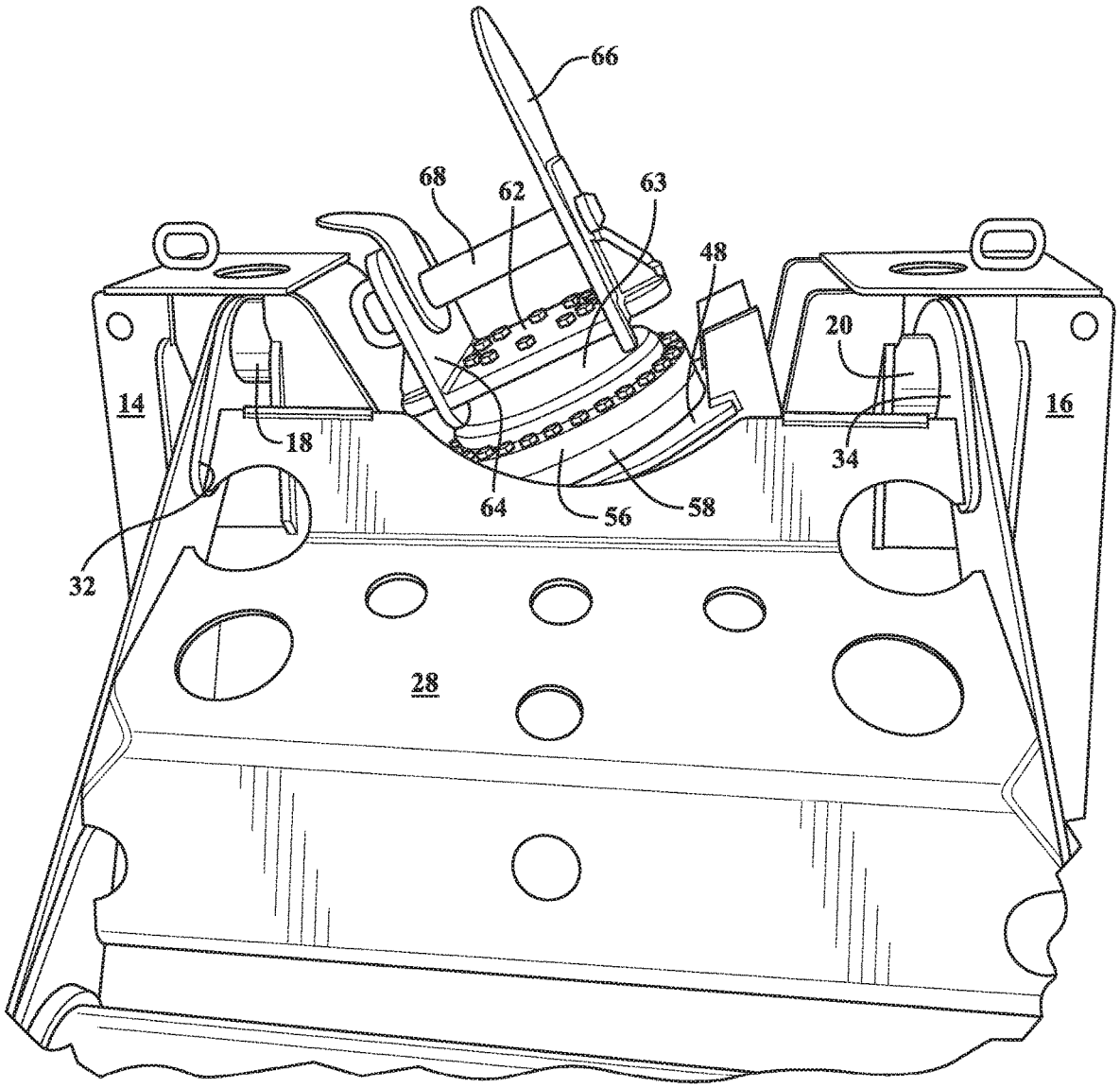
FIG. 7 is an elevated perspective view of the tilt head subassembly with hydraulic connection hookups according to the present invention.

FIG. 1, in combination with FIG. 7, further illustrates circular bearing supported carriage portions, at 56 and 58, which can be hydraulically or otherwise driven in order to rotate the tilt head assembly and the associated mounted bucket halves 28/30 about an axis (see at 60 in each of FIGS. 1 and 4) relative to the fixed member 4 of the excavator 2. As further best shown in FIG. 7, an uppermost attachment subassembly is configured upon the platen supported carriage portions 56/58, and in turn secures the tilt head frame 10 and bucket halves 28/30 to an end of the extending member 4 of the excavator or other suitable dredging equipment.

As best shown in FIG. 7, the attachment subassembly can include a base plate 62, and upwardly extending side plates 64/66 and which is affixed to an uppermost portion 63 of the platen carriage (such as shown by heavy duty mounting bolts). An end of the extending member 4 seats against the base plate 62 and can further include interior channeling for receiving a widthwise extending engagement pin 68 supported by the upper extending plates 64/66 in order to affix the frame 12 of the tilt assembly 10 to the excavator/dredger extending portion 4. In this fashion, the tilt assembly 10 of the present invention can be angularly position such as depicted in FIG. 1 relative to a length axis extending through the excavator's repositionable and end extending elongated member 4, this again in combination with the assembly being rotatable about the length axis of the excavator attachment member as again depicted at 60.

The extending plate 66 is further understood to include any type of caliper brake or other teethed arrangement/locking system for securing to the extended end of the excavator boom/member 4 to prevent relative movement in bucket positioning, and apart from desired tilt or rotation as provided for herein.

Pivoting or tilt of the platen (referenced by its lowermost support plate 48 about supported pin or shaft location 54) relative to the attachment frame 12 is provided by one or more hydraulic cylinders or actuators (these separate from those depicted in FIGS. 12-13 for inter-actuating the clamshell bucket halves 38/30). To this end, FIG. 9 depicts an underside view of the tilt head subassembly for adjusting an angular position of the pivotally supported tilt support plate 48 relative to the bucket supporting head frame 12.

Figure 8:
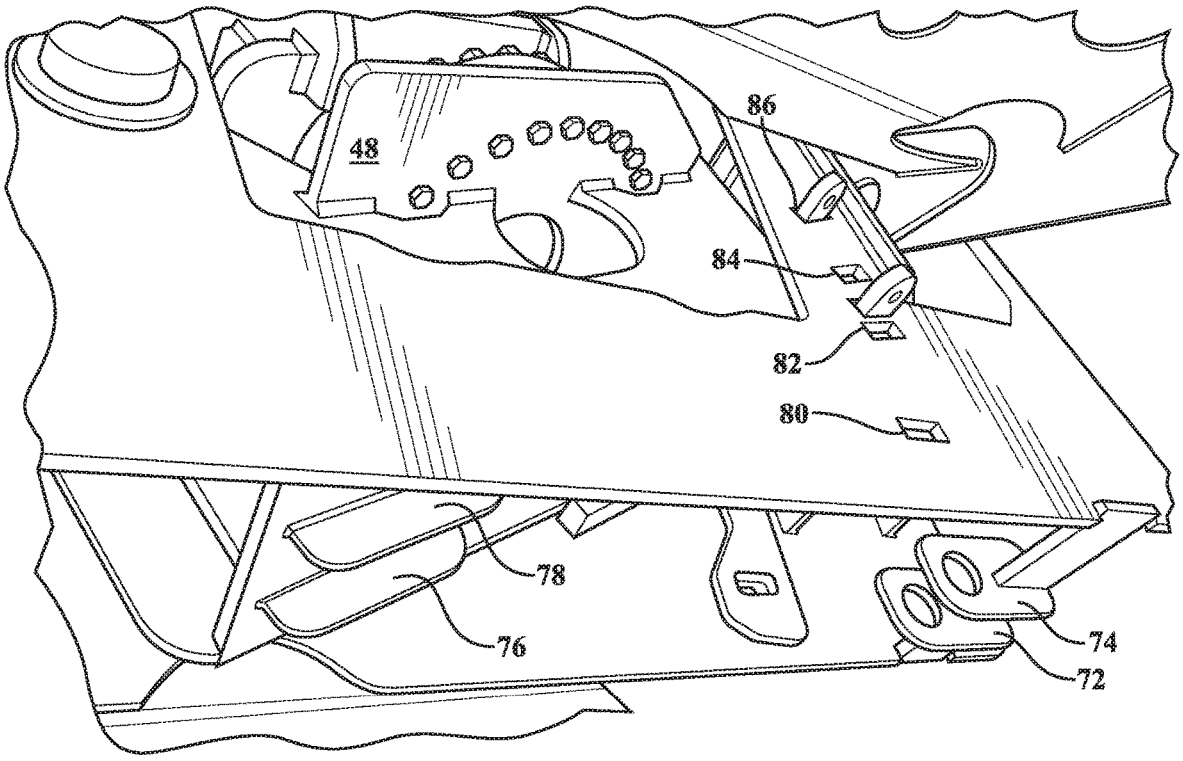
FIGS. 8-10 are a series of underside views of the tilt head subassembly and depicting a pivot mount for one or more hydraulic cylinders for adjusting an angular position of the pivotally supported tilt support plate relative to the bucket supporting head frame.
Figure 10:
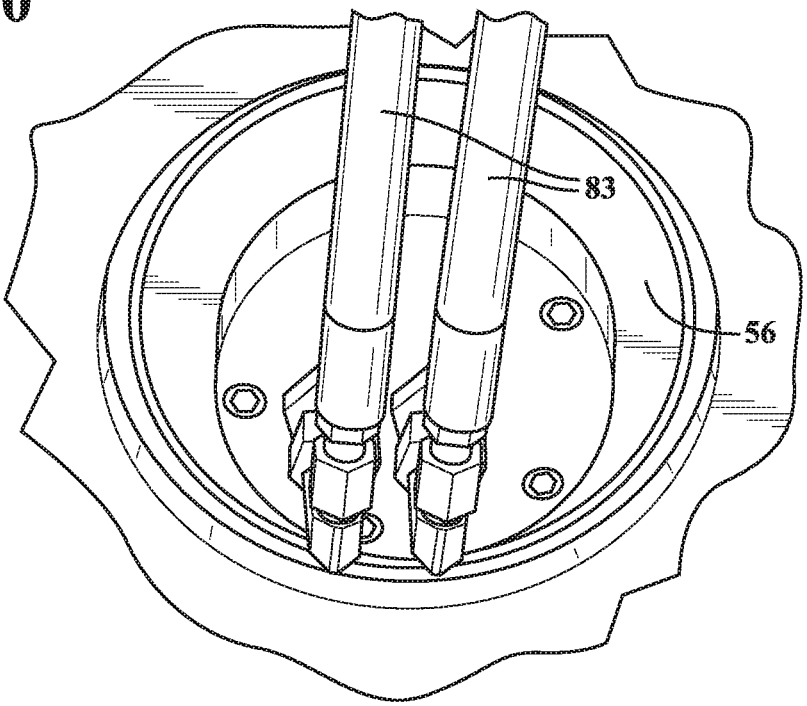
Figure 11:
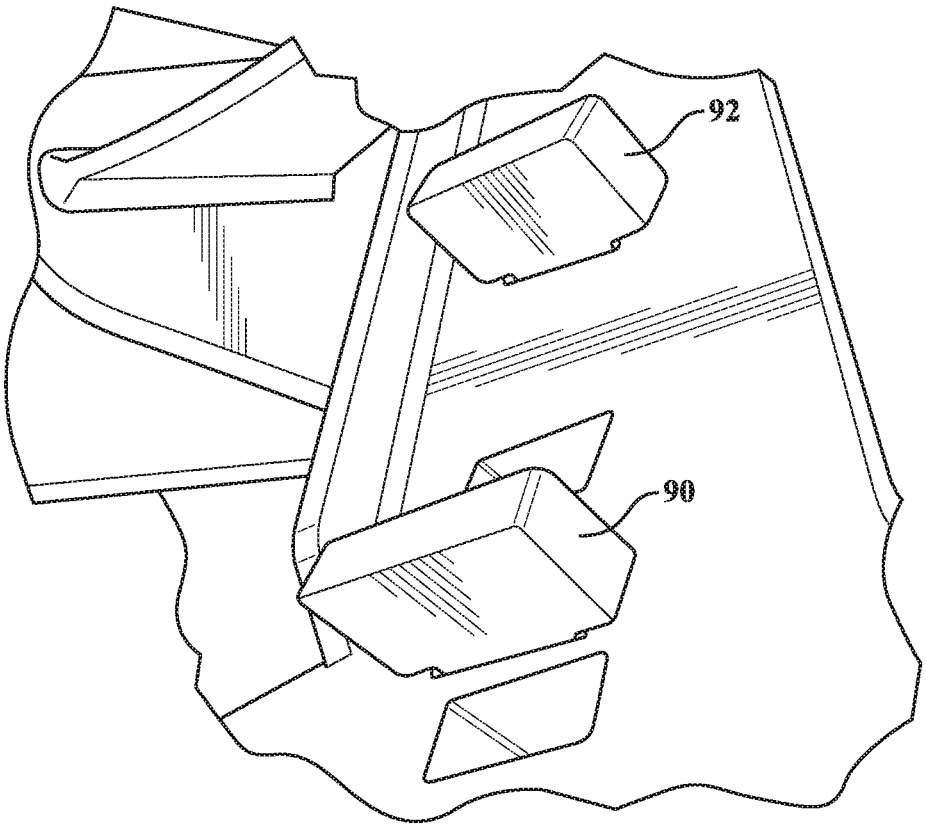
FIG. 11 is an illustration of the aligning slots for permitting insertion of a hold bar or pin to establish a desired angular position of the tilt head subassembly.

FIGS. 8-9 best depict spaced apart and opposing pairs 72/74 and 76/78 of cylinder mount brackets, these extending respectively from a fixed underside interior location of the frame 12 and the underside of the pivotally supported base platen 48. With particular reference to the underside perspective of FIG. 9, a further hydraulic cylinder (not to be confused with this those shown at 36/38 and 40/42 associated with the bucket halves) is provided and includes outer 77 and inner 79 telescoping portions which can be pivotally supported between the pairs of reinforced mount brackets 72/72 and 76/78. As previously indicated, hydraulic conduits 81 (see FIG. 9) can be provided for actuation of the tilt cylinder 77/79 for in turn tilting the frame and bucket. Additional hydraulic conduits 83 are shown in FIGS. 9-10, for powering the rotatable platen supported carriage components (the lower most of which is again depicted at 56 in FIG. 9) in order to separately rotate the head attachment frame 12 and associated bucket halves 28/30.

Additional features include an arrangement of aligning rectangular slot shaped apertures (hereinafter referred to as slots and depicted in FIGS. 5, 6 and 11) for permitting insertion of a hold bar or pin to establish a desired angular position of the tilt head subassembly. FIG. 2 is a plan view illustration of the bucket assembly of FIG. 1 with the head subassembly in a horizontal adjusted position and further showing the plurality of angular adjustment position slots 80, 82, 84, 86 and 88 configured within the forward plate of the support frame 12, with corresponding slots also provided for the rear plate, and as visible at 86' and 88' in FIG. 5 (see also as shown in FIGS. 2, 3 and 5). As further shown, the lowermost position defined by aligning slots 80/80' in the front and rear spaced apart plates corresponds to a generally horizontal orientation of the bucket halves, such as depicted in each of FIGS. 2 and 5, with the succeeding upper spaced and aligning slot positions 82/82', 84/84', 86/86' and 88/88' defining succeeding increased angular or tilt configurations as also shown in FIGS. 1 and 3 for achieving a tilted orientation of the bucket halves 28/30 relative to the elongated rigid support member 4 associated with the excavator equipment.

Upon aligning a pivotal or tilted position of the platen 48, At least one retainer bar (a pair of which are depicted at 90 and 92 in FIG. 11) is inserted through a selected aligning pair of slots 80/80', 82/82' et seq. formed in the front and rear spaced mount locations, along with alignment of the end slots (e.g. again as shown at 55) for the elongate and platen underside extending members 51 and 53, and in order to lock in place a desired angular position of the tilt head subassembly relative to the support frame and pivotally supported bucket halves 28/30. It is further understood that, while the hydraulic cylinder 77/29 of FIG. 9 for repositionally tilting or adjusting the platen and thereby the angle of bucket halves relative to the excavator arm 4, may be sufficient on its own to maintain a desired angle or tilt of the head attachment frame 12 (see again FIG. 1), the use of the securement bars 90/02 ensures maintaining the angular position of the head attachment frame 12 relative to the excavator arm 4 and which can be maintained over a number of repetitive dredging cycles.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A tilt adjustable head attachment assembly for a clamshell bucket for orienting first and second bucket halves at an angle relative to a length axis extending through an arm associated with a powered dredging equipment for supporting and manipulating the bucket, said attachment assembly comprising:

a frame connected to an end of the arm and to which are adapted to be pivotally and tilt-ably connected the first and second clamshell bucket halves;

said frame including a pair of spaced apart plates interconnected by crosswise members, said plates further defining a pair of spaced apart and upwardly extending pillar mounts;

a head attachment tilt subassembly including a four sided platen pivotally connected between said spaced apart pillar mounts of said frame, said platen contacting upper edges of said plates between said pillar mounts in a level orientation;

an annular shaped lower carriage member secured atop said platen;

an upper annular shaped carriage member adapted to being secured to the arm and rotating said lower carriage member, frame, head attachment tilt subassembly and bucket halves relative to an axis extending through the arm; and a cylinder connected to a fixed underside location of said frame at a first end and to said platen at a second end and so that, upon being actuated, pivotally displacing said platen away from said upper edges of said plates to in turn angle said frame and supported clamshell bucket halves relative to the arm.

2. The assembly of claim 1, further comprising said cylinder being supported between spaced apart and opposing pairs of cylinder mount brackets extending said frame to an underside of said pivotally supported platen.

3. The assembly of claim 1, further comprising pluralities of angular adjustment position defining slots formed in said spaced apart plates of said a pair of arms secured to said platen and being pivotally supported to said frame via a mounting shaft, a hold bar inserting through aligning pairs of said slots corresponding to an angled position of said platen in order to secure said platen in an adjusted tilt position relative to said frame and bucket halves.

4. The assembly of claim 1, further comprising a widthwise extending engagement pin supported by said spaced apart plates in order to affix the frame to the arm.

5. The assembly of claim 1, further comprising windows configured in said spaced apart plates in alignment with said pillar mounts, a pair of support shafts located in horizontal extending fashion within each of said pillar mounts which are visible through said windows and to which are engaged arms extending from the bucket halves.

6. The assembly of claim 5, further comprising separate first and second pairs of hydraulic cylinders being supplied by fluid conduits extending from the power equipment, inner hingedly supported ends of said pairs of cylinders being mounted to fixed end locations of said frame proximate said support shafts, opposite outer ends of an inner telescoping member for each of said pairs of cylinders further mounting to each of the bucket halves offset from said support shafts for maximizing pivoting forces exerted upon the bucket halves.

7. The assembly of claim 6, said fluid conduits further comprising individual pairs of fluid lines with associated hookups provided from the powered dredging equipment which can extend to each of said pairs of cylinders and are alternatively activated through the application of pressurized fluid for actuating said respective inner telescoping members and, by extension, the clamshell bucket halves between open and closed positions.

* * * * *